US005630229A

United States Patent [19]

Machado et al.

[11] Patent Number: 5,630,229

[45] Date of Patent: May 20, 1997

[54] ZIPPERLESS WETSUIT

[75] Inventors: Mark R. Machado, Newport Beach; Bradford D. Bissell, San Jose, both of Calif.

[73] Assignee: Billy International, Ltd., Costa Mesa, Calif.

[21] Appl. No.: 544,013

[22] Filed: Oct. 17, 1995

[51] Int. Cl.[6] ..... A41D 7/00

[52] U.S. Cl. ..... 2/2.15

[58] Field of Search ..... 2/2.15, 2, 69, 67, 2/82

[56] References Cited

U.S. PATENT DOCUMENTS

| | | | |
|---|---|---|---|
| D. 202,976 | 11/1965 | O'Neill . | |
| 1,706,097 | 3/1929 | Aud . | |
| 2,582,811 | 1/1952 | Williams . | |
| 3,493,972 | 2/1970 | Oldham . | |
| 4,276,341 | 6/1981 | Tanaka . | |
| 4,365,351 | 12/1982 | Doerschuk et al. . | |
| 4,448,251 | 5/1984 | Gauthier | 2/2 |
| 4,494,246 | 1/1985 | Tillbrook . | |
| 4,741,050 | 5/1988 | O'Kane et al. . | |
| 4,809,364 | 3/1989 | Lent . | |
| 4,853,976 | 8/1989 | Mertz . | |
| 4,999,845 | 3/1991 | Jenks et al. | 2/67 X |
| 5,052,053 | 10/1991 | Peart et al. . | |
| 5,109,546 | 5/1992 | Dicker | 2/69 X |
| 5,196,240 | 3/1993 | Stockwell . | |
| 5,282,277 | 2/1994 | Onozawa | 2/67 X |

FOREIGN PATENT DOCUMENTS

| | | |
|---|---|---|
| 353590 | 10/1947 | Japan . |
| 54-6569 | 2/1974 | Japan . |
| 55-95998 | 7/1980 | Japan . |
| 58-134198 | 9/1983 | Japan . |
| 613484 | 12/1983 | Japan . |
| 2-38886 | 1/1984 | Japan . |
| 63-44405 | 7/1984 | Japan . |
| 61-30017 | 2/1986 | Japan . |
| 3-18316 | 3/1986 | Japan . |
| 3-18315 | 3/1986 | Japan . |
| 61-50098 | 4/1986 | Japan . |
| 3-12636 | 4/1986 | Japan . |
| 57-36554 | 9/1986 | Japan . |
| 689509 | 10/1986 | Japan . |
| 63-123110 | 8/1988 | Japan . |
| 741916 | 8/1988 | Japan . |
| 741838 | 8/1988 | Japan . |
| 746365 | 10/1988 | Japan . |
| 1-97203 | 4/1989 | Japan . |
| 759804 | 4/1989 | Japan . |
| 789138 | 5/1990 | Japan . |
| 799094 | 10/1990 | Japan . |
| 7-6097 | 1/1995 | Japan . |
| 937094 | 10/1995 | Japan . |

OTHER PUBLICATIONS

Photographs of "Zero Mode" Wetsuit, (Japanese Manufacturer), Date Unknown.

*Primary Examiner*—C. D. Crowder
*Assistant Examiner*—Shirra L. Jenkins
*Attorney, Agent, or Firm*—Knobbe, Martens, Olson & Bear, LLP

[57] ABSTRACT

A zipperless wetsuit constructed of a plurality of panels of material, some of which are stretchier than others. A majority of an upper body region of the wetsuit is constructed of panels of highly stretchable wetsuit material which utilizes a central layer of foam rubber and one or two surrounding laminates of nylon having a higher denier value than previous wetsuits. Strategic panels of the wetsuit are constructed of single nylon laminate foam rubber material which has maximum pliability and stretchability. A double-collar upper entryway allows a wearer to enter the suit without the use of a zipper. An inner collar includes an aperture which may be stretched apart to allow entry of the wearer. An outer collar extends over the head of the wearer in a continuous circle to seal the inner collar against the wearer's neck. A rear bib attached to the back of the suit has a pair of adjustment straps which extend around either side of the neck of the wearer to couple with the outer surface of the outer collar and render the entry portion water-tight. Various panels of the suit are made of conventional material, with panels of varying flexibility to reduce the transitions between the less stretchy and more stretchy portions.

25 Claims, 2 Drawing Sheets

ZIPPERLESS WETSUIT

FIELD OF THE INVENTION

The present invention relates to wetsuits, and, in particular, to an improved zipperless wetsuit having maximum freedom of movement.

BACKGROUND OF THE INVENTION

Wetsuits are tight-fitting water-permeable suits worn by divers, surfers, board sailors, and swimmers in order to retain body heat. Modern wetsuits typically consist of flexible, heat-insulative material such as elastomer foam, one example being Neoprene foam. Full body wetsuits exhibit full-length arm and leg portions as well as the trunk portion. A spring suit is one which has short sleeves and shortened leg portions, and is typically used by surfers who desire greater freedom of movement. A bib top, similar to a tank top garment, may also be worn to increase the freedom of movement. One such bib top suit is seen in U.S. Pat. No. Des. 202,976. Of course, as the amount of wetsuit material is decreased, the amount of heat insulation decreases as well.

Contemporary full body and spring suits have a vertical zipper extending up the back which the wearer can unzip to form a large opening to step into and out of the suit. The zippers are typically made of noncorrosive material, such as plastic. The zippers extending up and down the back, however, greatly restrict freedom of movement, especially in forward bending. Other wetsuits provide a zipper for entry into the suit horizontally disposed across the chest. Although this zipper position does not restrict freedom of movement in forward bending, there is some restriction of upper body movement, and particularly lateral arm movement. Furthermore, the design of the zipper across the front of the suit detracts from the aesthetic appearance of the suit, and interferes with continuous logos or designs on the front of the suit.

One attempt at making a zipperless wetsuit is seen in U.S. Pat. No. 4,809,364, issued to Lent. In this patent, the wetsuit includes shoulder portions which can be laterally separated to expose a large aperture in the upper portion of the suit for the wearer to enter. The wearer then stretches a band from a left shoulder portion over the right side of the neck, and stretches the entire right shoulder portion over the left arm and over the head. The right shoulder portion covers the left shoulder portion, and leaves a large frontal panel 20 unconnected to the remainder of the suit at edge 20*a*. The unconnected edge 20*a* creates a relatively large gap in the material across the front of the chest which may allow water underneath the suit. Although a resilient neck portion 14*a* is provided to prevent water from entering the suit, the large unconnected edge 20*a* can allow water underneath the neck portion into the area surrounding free edge 21*a* and upper edge 21*b* of the left shoulder section. Furthermore, although the wetsuit ostensibly increases freedom of movement by the elimination of a zipper, the amount of material and awkward coupling of the lateral left and right shoulder portions across the wearer's upper body tends to restrain movement of one arm in relation to the other. Furthermore, the wetsuit is relatively awkward to put on.

A simpler design of a zipperless swimming suit is seen in U.S. Pat. No. 4,853,976. This suit is intended to be used by children when learning how to swim, and includes a trunk made of a double layer of Lycra® with a V-neck, allowing entry to the suit. The arms and legs of the suit are made of a single layer of lycra to facilitate freedom of movement. In the background of the invention, the patent teaches against adapting the design to wetsuits which are made from thicker, foam rubber material which can inhibit movement. The V-shaped opening at the top of the suit would not be practical with conventional wetsuits, which must have a relatively tight-fitting neck to prevent water ingress.

There is thus a need for a simpler, zipperless wetsuit which is both watertight and provides maximum freedom of movement.

SUMMARY OF THE INVENTION

The present invention provides a wetsuit having an inner collar defining an entryway for a human body between shoulders of the wetsuit. The inner collar has a relaxed size approximating a neckline of the wearer and is made of resilient material adapted to stretch at least two times its relaxed size to allow entry of a human into the wetsuit through the stretched entryway. An outer collar attaches to the wetsuit and has a closed circular portion adapted to stretch over the head of a wearer to overlie the inner collar and supplement a seal at the entryway preventing water ingress to the wetsuit. The outer collar is preferably mounted on a bib on a first side of the inner collar attached to pivot in a generally vertical plane, with a second bib provided on a second side opposite the inner collar from the first side and also attached to pivot in a generally vertical plane. The outer collar includes a fastener and the second bib has a complementary fastener on an adjustment strap to mate therewith and help seal the entryway. Preferably, the bibs attach to the front and rear sides of a trunk portion of the wetsuit.

The present invention, in another form, provides a zipperless entry wetsuit including a shoulder region with arms attached thereto, the shoulder region extending between upper portions of the arms. The wetsuit features a bib attached to the wetsuit to pivot freely with respect thereto and having an outer collar formed as a closed circle. The bib is located to allow the outer collar to extend over the head of a wearer of the wetsuit and overlie the shoulder region. An inner collar defines an entryway centered in the shoulder region between the arm upper portions and underneath the outer collar when the outer collar extends over the wearer's head. The inner collar is made of resilient material adapted to stretch to allow entry of a human into the wetsuit through the entryway. Desirably, the bib attaches to the wetsuit on a first side of the inner collar, and a second bib attaches to the wetsuit on a second side opposite the first side. The outer collar preferably includes a fastener and the second bib has an adjustment strap with a complementary fastener to mate therewith and help seal the entryway.

In another aspect, the invention provides a method of manufacturing a wetsuit comprising stitching one or more panels of foam rubber material having an inner laminate of nylon together to form an inner collar defining an upper entryway. In a relaxed state the entryway is sized to conform to a neckline of a wearer of the wetsuit, yet the material has sufficient flexibility to stretch apart at least twice its relaxed size. The method includes stitching a bib to a first side of the entryway so as to pivot in a generally vertical plane about a stitchline, the bib having a circular outer collar positioned to extend over the head of a wearer to overlie the inner collar and seal the entryway from water ingress. A fastening means is provided on the outer collar and a second bib is formed on the wetsuit on a second side opposite the inner collar from the first side. The second bib has bifurcated adjustment straps with fastening means complementary to the outer collar fastening means. Desirably, the method also includes attaching a tubular neck to an upper edge of the outer collar, the neck being formed of more flexible material than the collar to snugly conform to the neck of a wearer.

DETAILED DESCRIPTION OF THE PREFERRED EMBODIMENT

Figure 1:
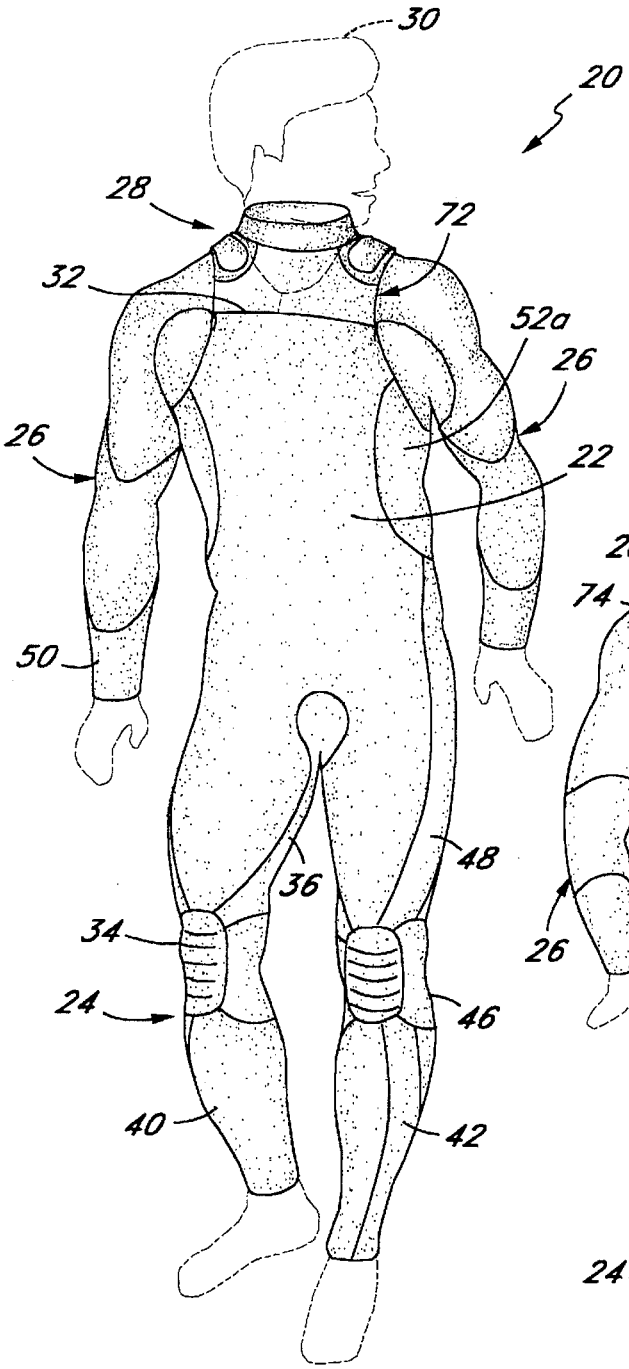
FIG. 1 is a front perspective view of a zipperless wetsuit of the present invention.
Figure 2:
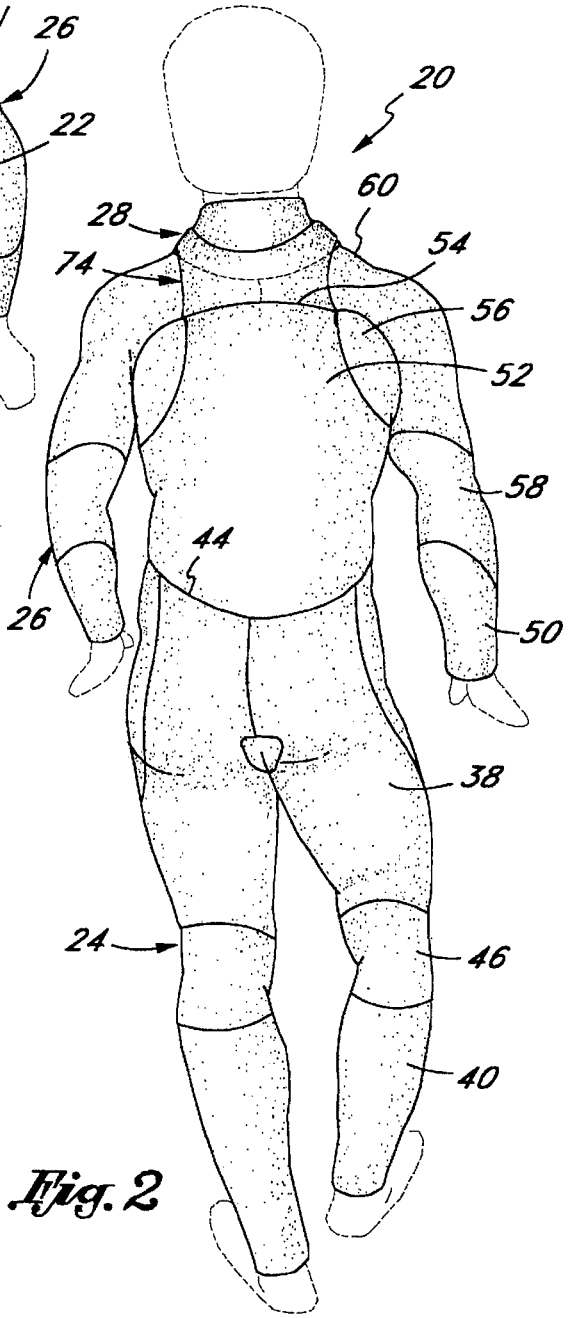
FIG. 2 is a rear perspective view of the zipperless wetsuit.

FIGS. 1 and 2, respectively, illustrate front and rear views of a zipperless wetsuit 20 of the present invention. As used herein, the term "zipperless" refers to the lack of a zippered main entryway in the wetsuit 20, and it will be understood that auxiliary zippered structures, such as pockets or leg closures, may be incorporated. Although the present zipperless wetsuit is shown and described in conjunction with a full-body suit, many of the inventive aspects can readily be adapted to other styles, such as spring suits, which typically make use of a zippered entry opening.

The wetsuit 20 comprises a trunk portion 22, a pair of legs 24, a pair of arms 26, and an upper entryway 28 in the region of a neck of a wearer 30, shown in phantom. The wetsuit 20 is generally continuous in a single layer in all areas except for the upper entryway 28. The wearer 30 steps into the wetsuit 20 through the upper entryway 28, as will be more fully described below.

The wetsuit 20 is made with a plurality of panels of foam rubber, preferably Neoprene, having at least an inner layer or laminate of nylon for strength, some of the panels being more pliable than others. In particular, certain regions in the upper body portion of the wetsuit 20 are significantly more stretchy than a majority of the trunk portion 22 of the wetsuit, which is made of conventional wetsuit material. Wetsuits are typically constructed entirely of two or three millimeter thick foam rubber sandwiched between two laminates of nylon, inside and outside. This conventional type of wetsuit material is very durable, and has a high heat insulation capacity.

The nylon laminate is formed by a weave of long nylon strands and is characterized by a particular density, or denier number, according to industry standards. The denier number is a unit of fineness denoting the weight (or mass) of a specified length of nylon strand. One industry standard used is the gram weight of the nylon per 9000 meters of strand. A conventional type of nylon used in wetsuits has a denier number of 70. The nylon strands are twisted together in a crosswise fashion, and the higher the density of the weave, the closer together the adjacent parallel strands, resulting in more and bigger loops in each cross strands, and visa versa. Because there are more and bigger loops per strand, each strand travels a longer path through a given length of material and, consequently, has more slack therein, allowing greater expansion when the ends are pulled. Over an area of such high density nylon weave, the fabric can be stretched in two dimensions to a much greater extent than straighter weave nylon fabric. Because there are more strands per area of fabric, a finer nylon is used with a reduced denier number below that of the nylon in conventional wetsuit material, and preferably less than half the denier number used in conventional material. The finer strands allow for the more pliable weave without unduly increasing the overall weight of the garment. Additionally, to ensure maximum stretchiness, the nylon fabric is laminated onto the inner foam layer in an unstretched state.

As mentioned above, conventional wetsuit material includes inner and outer laminates of nylon having a denier number of 70 grams per 9000 meters of nylon strand. One type of conventional material used in the wetsuit 20 of the present invention includes an inner layer of 3-mm thick foam rubber sandwiched between outer laminates of 70 denier nylon fabric, and is termed herein "3-mm Nylon II." Also utilized in the wetsuit 20 is a slightly thinner type of conventional wetsuit material termed "2-mm Nylon II." The 2-mm Nylon II material also has inner and outer laminates of 70 denier nylon, as indicated by the Roman numeral II designation, but the sandwiched layer of foam rubber is only 2 millimeters thick. This results in a slightly less effective heat insulator which is slightly more pliable and stretchy.

In accordance with an important aspect of the present invention, the wetsuit 20 incorporates a type of wetsuit material which allows for greater freedom of movement in the upper body portion, and also allows for the zipperless entryway 28 surrounding the neck of the suit. The material has an inner laminate of nylon, and may also have an outer laminate of nylon, the strands of nylon in the laminates being finer with a denier of less than 70, and preferably less than 35. In a preferred embodiment, the strands of nylon in the laminates have a denier humber of about 30, equivalent to a mass of 30 grams per 9000 meters of yarn. The finer nylon strands enable the nylon weave to be closer together, with more loops, than conventional weaves, which greatly increases the pliability and stretchiness of this material. Several types of this new material are used throughout the wetsuit 20. A first type includes a 2- or 3-mm thick layer of foam rubber with a single laminate of 30 denier nylon, and is termed "Nylon I Megastretch™." (Megastretch™ is a Trademark of Billy International, Ltd. of Costa Mesa, Calif.) A second type, termed "Nylon II Megastretch™," which is slightly less pliable, includes a 2- or 3-mm thick layer of foam rubber sandwiched by laminates of the 30 denier nylon. Material utilizing 3-mm thick as opposed to 2-mm thick foam rubber is nominally less stretchy, the stretchiness being primarily determined by the type of nylon laminate. Thus, the Megastretch™ material using 30 denier nylon laminates and a closer weave is significantly more stretchy than conventional material using 70 denier nylon laminates and a conventional weave regardless of the thickness of the foam rubber layer.

Referring again to FIGS. 1 and 2, the trunk portion 22 is made of a single panel of 3-mm Nylon II material. The trunk portion 22 extends from a generally horizontal front stitch line 32 downward to a pair of kneepads 34 preferably made of thick Kevlar®. The region 36 between the thighs is also made of 3-mm Nylon II material. Looking at the rear view of FIG. 2, the seat and rear upper leg portion 38 is similarly made of the 3-mm Nylon II material. In the lower leg area, a large panel 40 of 3-mm Nylon II material extends substantially around the leg, except in a small vertical strip, or lower leg flexure, 42.

From a belt line 44, seen in FIG. 2, downward, the wetsuit 20 is composed of panels of only conventional 3-mm Nylon II or 2-mm Nylon II material. In this regard, in addition to the vertical strips, or lower leg flexures, 42 a knee flexure 46 constructed of 2-mm Nylon II material, is provided. Two generally vertical strips, or hip flexures, 48 extend from the belt line 44 downward on the outer side of the thighs to the knee region. The lower leg flexure 42 knee flexure 46, and hip flexure 48 are all made of 2-mm Nylon II material, and provide increased freedom of movement for the wearer 30 in the leg region. Additionally, these strategically placed panels of 2-mm Nylon II material allow for a more "one size fits all" wetsuit 20. In other words, the lower portion of the wetsuit 20 stretches somewhat more than a monolithic panel of 3-mm Nylon II material would, and thus fits a greater range of sizes of wearer 30. The only other portion of the wetsuit 20 which incorporates panels of conventional wetsuit material, are the wrist flexures 50, which are preferably constructed of 2-mm Nylon II material for added pliability for the forearm of the user.

The remainder of the wetsuit 20 is constructed of panels of either 2- or 3-mm Nylon I Megastretch™, or Nylon II Megastretch™. In a departure from conventional wetsuits, the present suit 20 incorporates a large area of Nylon I Megastretch™, which does not include an outer laminate of nylon. Although this decreases the durability of the material somewhat, the added benefit from greater freedom of movement is valued more highly by many wearers. Furthermore, the panels of Nylon I Megastretch™ are positioned in areas which allow for great freedom of movement of the upper body, but which are less likely to be abraded from contact with rough surfboards, for example. Although the single laminate of nylon is preferably formed on the inside of the wetsuit for comfort of the wearer, it is conceivable that the laminate could be formed on the outside.

With reference again to FIGS. 1 and 2, a large back region 52 made of Nylon I Megastretch™ extends between a rear stitch line 54 and the belt line 44 in the back, and extends around the front at 52*a* to join with the trunk portion 22. The back region 52 represents a significant change between the present wetsuit 20 and previous wetsuits which include a zipper up the back. The back of the suit is thus extremely pliable, and may stretch to a much greater extent than if a rigid zipper were in place, or if the region were made of conventional wetsuit material. This allows much greater freedom of movement in forward bending for the wearer 30. The upper lateral edges of the back portion 52 are joined with an underarm region 56, which is preferably constructed of Nylon II Megastretch™. The Nylon II Megastretch™ is preferred in this region, because of the repeated abrasions from arm movement. The elbow regions 58 on the arms connected to the wrist flexures 50 are constructed of Nylon I Megastretch™ material for maximum flexibility. Farther up the arm, the shoulder region 60, which, as will be seen below with reference to FIGS. 3*a–c*, extends across the upper body portion of the suit 20, is preferably constructed of Nylon II Megastretch™. The upper entryway 28 includes a variety of different panels of material, as will be more fully explained below with reference to the manner in which a wearer 30 can enter the suit 20.

Figure 3C:
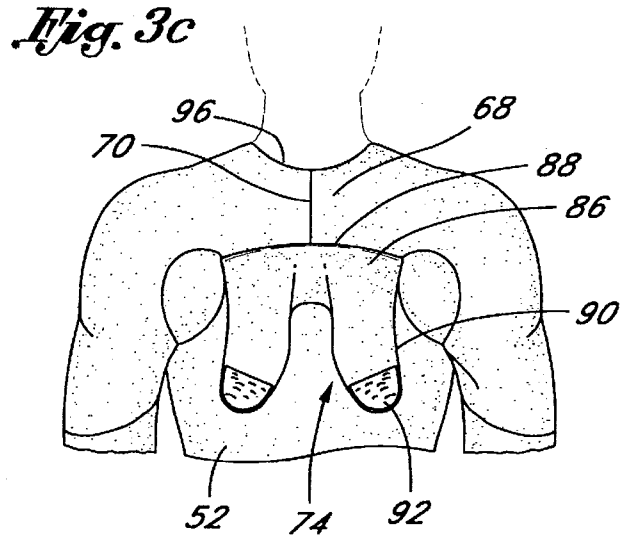
FIG. 3*c* is a rear elevational view of the wetsuit prior to sealing an upper entryway.
Figure 3B:
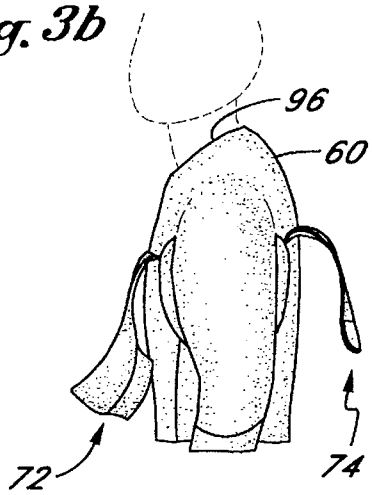
FIG. 3*b* is a left side elevational view of the upper portion of the wetsuit prior to sealing an upper entryway.
Figure 3A:
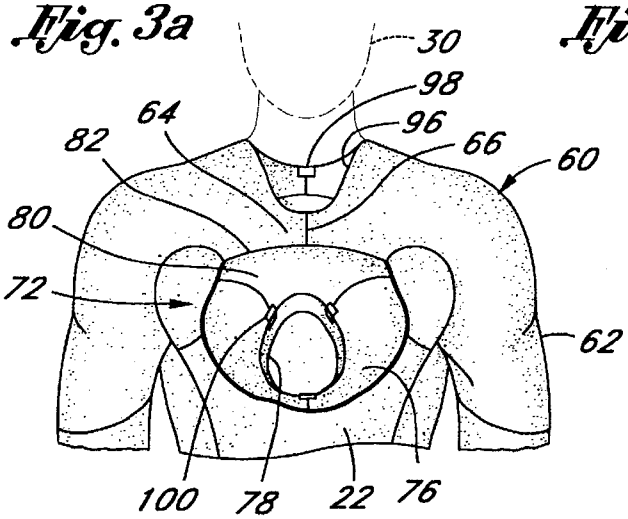
FIG. 3*a* is a front, elevational view of an upper portion of the wetsuit of FIG. 1 prior to sealing an upper entryway.
Figure 4C:
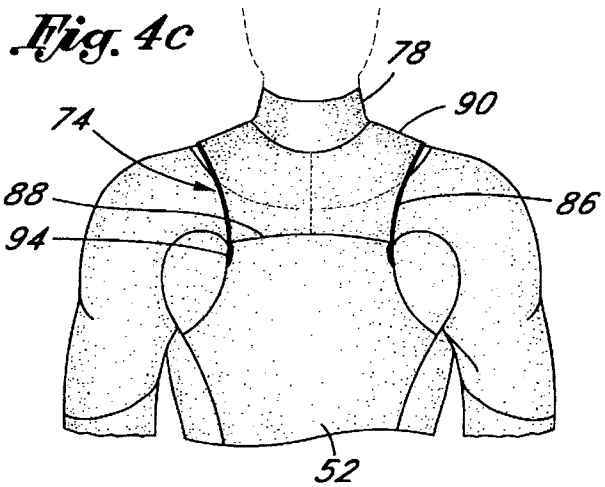
FIG. 4*c* is a rear elevational view of the upper portion of the wetsuit after sealing an upper entryway.
Figure 4B:
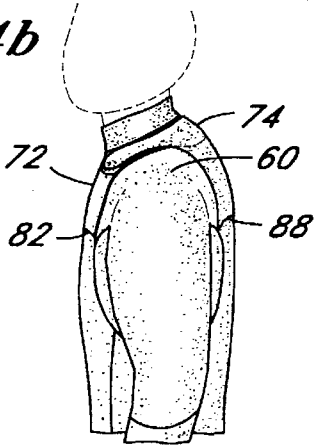
FIG. 4*b* is a left side elevational view of the upper portion of the wetsuit after sealing an upper entryway.
Figure 4A:
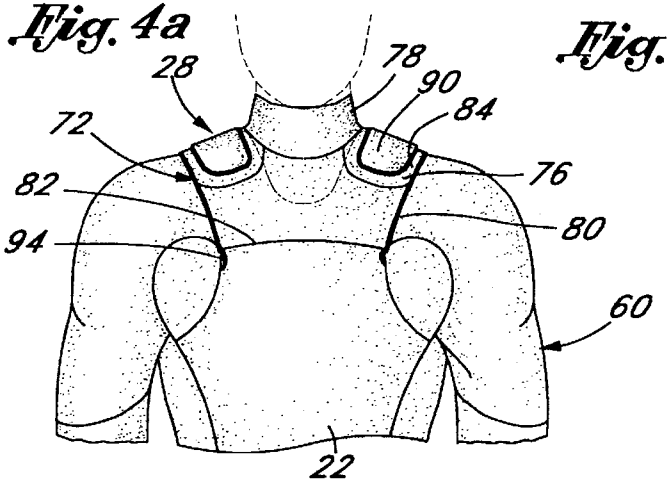
FIG. 4*a* is a front elevational view of the upper portion of the wetsuit after sealing an upper entryway.

FIGS. 3*a–c* illustrate various views of the upper portion of the wetsuit 20 with the outer collar 76 removed from the neck of the wearer 30, therefore allowing entry to the suit. FIGS. 4*a–c*, on the other hand, illustrate the upper portion of the wetsuit 20 with the upper entryway 28 closed and sealed. It can be seen from the views of FIGS. 3*a–c* that the shoulder region 60 extends across the suit 20 from side-to-side. More particularly, the shoulder region 60 includes upper arm sections 62, clavicle sections 64 joined at a front seam 66, and rear upper back portions 68 joined at a rear seam 70. The use of Nylon II Megastretch™ material across the entire shoulder region 60 is a departure from previous suits, which relied on less pliable, albeit more durable, conventional 3-mm Nylon II material. Surfers in particular require great freedom of motion in the upper body when paddling to catch waves. The present suit 20 greatly facilitates this upper body motion.

As seen in the views of FIGS. 1 and 2, and in FIGS. 4*a–4c*, a front or first bib 72, and a rear or second bib 74, cover the central portion of the shoulder region 60. The first bib 72 preferably attaches to a first or front side of the wetsuit, and the second bib 74 attaches to a rear or second side of the wetsuit; the two bibs extending upward to overlap around the upper entryway 28 of the wetsuit 20. As will be apparent from the drawings and following description, the location of the bibs may be reversed so that the first bib 72 attaches to the rear side of the wetsuit, and the second bib 74 attaches to the front side of the wetsuit.

The first bib 72 comprises a continuous circular collar 76 topped at an upper edge by a tubular neck 78. The circular region extends over the head of the wearer 30 and attaches by a flap 80 at a front or first bib seam 82 to the lower edge of the clavicle region 64. The flap 80 is preferably constructed of relatively durable 3-mm Nylon II material, while the collar 76 is constructed of 3 millimeter nylon plush material, which includes an inner laminate of nylon, and an outer layer of hook/loop material 84. The neck 78, on the other hand, is constructed of pliable Nylon I Megastretch™ material. As mentioned, the collar 76 extends over the head of the wearer, so that the neck 78 snugly conforms to the wearer's neck.

The second bib 74, as best seen in FIG. 3*c*, comprises a flap portion 86 attached to the rear upper back portion 68 of the shoulder region 60 at a rear or second seam 88. The second bib 74 further includes a pair of bifurcated adjustment straps 90 having large patches of hook/loop material 92 fastened to the inner surface of the free ends. In contrast to the first bib 72, the second bib 74 is constructed entirely of Nylon I Megastretch™ material and desirably forms a continuation of the back region 52. The second bib 74 is adapted to extend upward with the bifurcated adjustment straps 90 extending around either side of the wearer's neck. More particularly, the second bib 74 is adapted to attach to the first bib 72 to close and seal the upper entryway 28 by engagement between the hook and loop material regions 84, 92. Although hook and loop fasteners are preferred for their flexibility and ease of use, other types of fasteners such as bra-hook types, double D-ring and strap types, plastic buckle types, etc., may be substituted.

Because the first and second bibs 72, 74 are repeatedly disengaged and experience a significant amount of stress at their connections with the suit 20, the seams 82 and 88 are curved with a center portion higher than the edge portions. This curve preferably reduces localized stresses imposed on the edges, which would be the case if the stitch lines 82 and 88 were horizontal. Furthermore, as seen in FIGS. 4*a* and 4*c*, the edges of the stitch lines 82 and 88 are reinforced with bar tacks 94 comprising a highly concentrated region of stitching. These bar tacks are conventionally used in the apparel industry to reinforce critical areas which experience the greatest stress.

The shoulder region 60 defines an inner collar 96 which drops down farther in the front than in the rear, as seen in FIG. 3*a*. The inner collar 96 helps prevent water from entering underneath the wetsuit 20 in concert with the overlapping outer collar 76. In this respect, the inner collar 96 does not tightly conform to the neck of the wearer, but is instead formed to allow the wearer easy entry to the suit 20. More specifically, the inner collar 96 follows a neckline of the wearer 30, as best seen in FIG. 3*a*, which traverses the base of the wearer's neck and drops down in front to approximately the top of the sternum. The particular relaxed diameter of the inner collar 96 will vary depending on the intended wearer, and thus is best characterized as conforming to the neck of the wearer underneath the outer collar 76. The border of the inner collar 96 is left raw and unhemmed so as to allow for maximum stretch of the entry opening formed thereby.

The present wetsuit 20 enjoys the advantages of no zippered opening due to the stretchy inner collar 96 while still forming an effective seal around the entryway 28. The Nylon II Megastretch™ material of the inner collar 96 is not sufficiently rigid to prevent water ingress to the inside of the suit 20. The outer collar 76, however, constructed of stiffer conventional wetsuit material, supplements the seal of inner collar 96. More particularly, the outer collar 76 clamps down on the region around the inner collar 96 and effectively seals the entryway 28 from ingress of water. The adjustment straps 90 on the second bib 74 pull downward on the outer collar 76 to further seal the entryway 28. The closely conforming neck 78 extending up the wearer's neck from the outer collar 76 further enhances the water seal.

It should be noted that although in the preferred embodiment the outer collar 76 forms a part of the first bib 72, it could alternatively form a part of the second bib 74, with the adjustment straps 90 extending over the shoulder region from the front to the rear. Indeed, the outer collar 76 might also extend from the side of the neck region with the adjustment straps joined on the suit on the opposite side. Still another embodiment could eliminate the adjustment straps 90 altogether with a hook and loop fastener provided between the inside of the outer collar 76 and the exterior of the shoulder region 60. As will be appreciated by one of skill in the art, various configurations of a stretchy inner collar and a stiffer overlying outer collar are possible within the scope of the present invention.

To put on the wetsuit 20, the wearer spreads the inner collar 96 apart a sufficient distance to insert the feet first, and then the remainder of his or her body. With the use of Nylon II Megastretch™ for the entire shoulder region 60 including the inner collar 96, the entry opening may easily be stretched apart 2–3 or more times its relaxed size without undue stress on the material. Desirably, the inner collar 96 may repeatedly be stretched at least as wide as the width of the shoulder region 60, to provide the wearer easy entry into the suit 20, without material failure. The seams 66 and 70 at the front and back of the shoulder region 60 are reinforced at the inner collar 96 with adhesive tape patches 98. These tape patches are installed with a heat transfer glue, and one type is sold under the name Melco® tape patches. The patches 98 must be used at the inner collar 96 because the collar is not hemmed, but is rather left raw.

Once the wearer 30 has entered the suit 20 by stretching apart the inner collar 96, the first bib 72 pivots upward in a generally vertical plane about the stitchline 82 and the wearer pulls the outer collar 76 down over his or her head. The neck 78 thus conforms snugly to the wearer's neck. The second bib 74 is then pivoted upward about the stitchline 88 so that the two adjustment straps 90 extend around to the front of the wearer on either side of his or her neck, as been seen in FIG. 4*a*. Pressing down the free ends of the adjustment straps 90 engages the hook/loop material 92 with the hook/loop material 84 on the collar 76. Due to the stretchiness of the adjustment straps 90, the upper entryway 28 seal can be tightened or loosened, depending on the relative size of the wearer. This further enhances the "one size fits all" characteristic of the present wetsuit 20.

The majority of the panels of the wetsuit 20 are stitched together using conventional wetsuit apparel techniques. In this regard, blind stitches are used between the panels of conventional wetsuit material. Where the single lined Nylon I Megastretch™ material is used, on the other hand, blind stitches are not used, because the stitching would puncture the outer surface of foam rubber, possibly instigating rips therein. In this regard, such is at the junction surrounding the back region 52, a single-sided stitch is used on the interior of the suit, the back region 52 having a laminate of nylon on the inner surface. The exterior line of these junctions may be sealed with a suitable flexible adhesive. Furthermore, as seen in FIG. 3*a*, reinforcing tape patches 100 are utilized at the junction between the neck 78 and the collar 76. This region experiences a high level of stress when the wearer inserts his or her head through the neck 78, and must be reinforced without the use of bar tacks.

Although this invention has been described in terms of certain preferred embodiments, other embodiments that are apparent to those of ordinary skill in the art are also within the scope of this invention. For example, other suitable materials than those described and other designs incorporating the advantageous features of the wetsuit are contemplated within the scope of the invention. Accordingly, the scope of the invention is intended to be defined by the claims that follow.

What is claimed is:

1. A wetsuit, comprising:

an inner collar defining an entryway for a human body between shoulders of the wetsuit, the inner collar having a relaxed size approximating a neckline of the wearer and made of resilient material adapted to stretch at least two times its relaxed size to allow entry of a human into the wetsuit through the stretched entryway;

an outer collar attached to the wetsuit and laving a closed circular portion adapted to stretch over the head of a wearer to overlie the inner collar and supplement a seal at the entryway preventing water ingress to the wetsuit;

a first bib extending from said wetsuit on a first side of said inner collar, said outer collar being attached to said first bib; and a second bib extending from said wetsuit on a second side of said inner collar opposite from said first side and including an adjustment strap, wherein said outer collar includes a fastener and said strap has a complementary fastener to mate with said outer collar fastener and help seal said entryway.

2. The wetsuit of claim 1, further including a trunk portion, wherein said firm bib extends from one of the front or rear sides of said trunk portion, and said second bib extends from the other of the front or rear sides of said trunk portion.

3. The wetsuit of claim 1, wherein said first bib includes a flap portion extending from one of the front or rear sides of said trunk portion at a seam so as to allow said first bib to pivot in a generally vertical plane, and said second bib includes a flap portion extending from the other of the front or rear sides of said trunk portion at a seam so as to allow said second bib to pivot in a generally vertical plane.

4. The wetsuit of claim 3, wherein said first bib seam is curved with a center portion higher than lateral edge portions, and said second bib seam is curved with a center portion higher than lateral edge portions.

5. The wetsuit of claim 3, wherein said first bib seam is reinforced with bar tacks at lateral edge portions, and said second bib seam is reinforced with bar tacks at lateral edge portions.

6. The wetsuit of claim 1, wherein said second bib includes bifurcated adjustment straps sized to extend from said second side on both sides of said inner collar to said first side to adjustably fasten to said outer collar.

7. The wetsuit of claim 1, wherein said outer collar fastener and said strap fastener comprise regions of hook and loop fastener material.

8. The wetsuit of claim 7, wherein said outer collar fastener is formed on an exterior surface thereof, and said strap fastener is formed on an interior surface thereof, such that said strap extends from one side of said inner collar over said outer collar to adjustably fasten thereto.

9. The wetsuit of claim 1, wherein said outer collar is made of a material having a layer of foam rubber and at least one laminate of nylon, and said inner collar is made of a material having a layer of foam rubber and at least one laminate of nylon, wherein the nylon used in said inner collar has a lower denier number than the nylon used in said outer collar.

10. The wetsuit of claim 9, wherein the nylon used in said inner collar has a denier number of less than half the denier number of the nylon used in said outer collar.

11. The wetsuit of claim 10, wherein said wetsuit includes a trunk portion with arms attached thereto, and said inner collar forms a central portion of a shoulder region extending between an upper portion of said arms, said shoulder region and said inner collar being constructed of the same material.

12. The wetsuit of claim 1, wherein said wetsuit is a full body wetsuit including a trunk portion and arms and legs attached to said trunk portion, and said inner collar forms a central portion of a shoulder region extending between an upper portion of said arms, said shoulder region and said inner collar being formed of a single panel of material.

13. The wetsuit of claim 1, further including a tubular neck attached to said outer collar and formed of material more stretchy than said outer collar, said neck adapted to snugly conform to a human neck to supplement said entryway seal.

14. A zipperless entry wetsuit including a shoulder region with arms attached thereto, the shoulder region extending between upper portions of said arms, comprising:

a bib extending from the wetsuit to pivot freely with respect thereto and having an outer collar formed as a closed circle, the bib located to allow the outer collar to extend over the head of a wearer of the wetsuit and overlie said shoulder region;

an inner collar defining an entryway centered in said shoulder region between said arm upper portions, said inner collar formed in said shoulder region underneath said outer collar when said outer collar extends over the wearer's head, said inner collar made of resilient material adapted to stretch to allow entry of a human into the wetsuit through said entryway, wherein said bib extends from said wetsuit on a first side of said inner collar; and a second bib extending from said wetsuit on a second side opposite said inner collar from said first side and including an adjustment strap, wherein said outer collar includes a fastener and said strap has a complementary fastener to mate with said outer collar fastener and help seal said entryway.

15. The wetsuit of claim 14, wherein said bib extends from one of the front sides of said shoulder region and said second bib extends from the other of the front or rear sides of said shoulder region.

16. The wetsuit of claim 14, wherein said second bib includes bifurcated adjustment straps sized to extend from said second side on both sides of said inner collar to said first side to adjustably fasten to said outer collar.

17. The wetsuit of claim 16, wherein said outer collar fastener and said strap fastener comprise regions of hook and loop fastener material.

18. The wetsuit of claim 14, wherein said bib extends from said shoulder region so as to allow said bib to pivot in a generally vertical plane.

19. A method of manufacturing a wetsuit comprising:

stitching one or more panels of foam rubber material having an inner laminate of nylon together to form an inner collar defining an upper entryway, in a relaxed state the entryway being sized to conform to a neckline of a wearer of the wetsuit, said material having sufficient flexibility to allow said entryway to stretch apart at least twice its relaxed size;

stitching a bib to a first side of said entryway, said bib adapted to pivot in a generally vertical plane about a stitchline and having a circular outer collar positioned to extend over the head of a wearer to overlie said inner collar and seal said entryway from water ingress;

providing a fastening means on said outer collar; and forming a second bib on said wetsuit on a second side opposite said inner collar from said first side, said second bib having bifurcated adjustment straps, said straps having fastening means complementary to said outer collar fastening means.

20. The method of claim 19, further comprising the step of:

attaching a tubular neck to an upper edge of said outer collar, said neck being formed of more flexible material than said collar to snugly conform to the neck of a wearer.

21. A wetsuit, comprising:

an inner collar defining an entryway for a human body between shoulders of the wetsuit, the inner collar having a relaxed size approximating a neckline of the wearer and made of resilient material adapted to stretch to allow entry of a human into the wetsuit through the stretched entryway; and an outer collar attached to the wetsuit and having a closed circular portion adapted to stretch over the head of a wearer to overlie the inner collar and supplement a seal at the entryway preventing water ingress to the wetsuit, wherein said outer collar is made of a material having a layer of foam rubber and at least one laminate of nylon, and said inner collar is made of a material having a layer of foam rubber and at least one laminate of nylon, wherein the nylon used in said inner collar has a lower denier number than the nylon used in said outer collar.

22. The wetsuit of claim 21, wherein the nylon used in said inner collar has a denier number of less than half the denier number of the nylon used in said outer collar.

23. The wetsuit of claim 22, wherein said wetsuit includes a trunk portion with arms attached thereto, and said inner collar forms a central portion of a shoulder region extending between an upper portion of said arms, said shoulder region and said inner collar being constructed of the same material.

24. A wetsuit, comprising:

an inner collar defining an entryway for a human body between shoulders of the wetsuit, the inner collar having a relaxed size approximating a neckline of the wearer and made of resilient material adapted to stretch to allow entry of a human into the wetsuit through the stretched entryway; and an outer collar attached to the wetsuit and having a closed circular portion adapted to stretch over the head of a wearer to overlie the inner collar and supplement a seal at the entryway preventing water ingress to the wetsuit, wherein said wetsuit includes a trunk portion and arms and legs attached to said trunk portion, and said inner collar forms a central portion of a shoulder region extending between an upper portion of said arms, said shoulder region and said inner collar being formed of a single panel of material.

25. A wetsuit, comprising:

an inner collar defining an entryway for a human body between shoulders of the wetsuit, the inner collar having a relaxed size approximating a neckline of the wearer and made of resilient material adapted to stretch to allow entry of a human into the wetsuit through the stretched entryway;

an outer collar attached to the wetsuit and having a closed circular portion adapted to stretch over the head of a wearer to overlie the inner collar and supplement a seal at the entryway preventing water ingress to the wetsuit; and a tabular neck attached to said outer collar and formed of material more stretchy than said outer collar, said neck adapted to snugly conform to a human neck to supplement said entryway seal.

* * * * *

UNITED STATES PATENT AND TRADEMARK OFFICE

CERTIFICATE OF CORRECTION

PATENT NO. : 5,630,229

DATED : May 20, 1997

INVENTOR(S) : Mark R. Machado et al.

It is certified that error appears in the above-identified patent and that said Letters Patent is hereby corrected as shown below:

Column 4, Line 36, change "denier humber" to --denier number--;

Column 8, Line 42, change "and laving" to --and having--;

Column 8, Line 57, change "said firm bib" to --said first bib--;

Column 10, Line 4, change "from one of the front sides" to --from one of the front or rear sides--; and Column 12, Line 13, change "a tabular neck" to --a tubular neck--.

Signed and Sealed this

Twenty-third Day of December, 1997

*Attest:*

*Attesting Officer*

BRUCE LEHMAN

*Commissioner of Patents and Trademarks*